US007281715B2

(12) United States Patent
Boswell

(10) Patent No.: US 7,281,715 B2
(45) Date of Patent: Oct. 16, 2007

(54) COOKTOP GASKET

(75) Inventor: Tyler G. Boswell, Weatherford, TX (US)

(73) Assignee: M Management-Tex, Ltd., Fort Worth, TX (US)

( * ) Notice: Subject to any disclaimer, the term of this patent is extended or adjusted under 35 U.S.C. 154(b) by 135 days.

(21) Appl. No.: 11/069,431

(22) Filed: Mar. 1, 2005

(65) Prior Publication Data

US 2005/0194004 A1 Sep. 8, 2005

Related U.S. Application Data

(60) Provisional application No. 60/549,309, filed on Mar. 2, 2004.

(51) Int. Cl.
*H05B 3/68* (2006.01)
*F24C 15/10* (2006.01)
*F16J 15/02* (2006.01)

(52) U.S. Cl. ..... 277/641; 277/647; 219/452.11; 219/452.12

(58) Field of Classification Search ..... 277/641, 277/647; 219/452.11, 452.12
See application file for complete search history.

(56) References Cited

U.S. PATENT DOCUMENTS 4,222,576 A * 9/1980 Clements ..... 277/641
4,313,609 A * 2/1982 Clements ..... 277/641
5,036,831 A * 8/1991 Ray ..... 126/211
5,183,996 A * 2/1993 Hazan et al. ..... 219/445.1
5,785,047 A * 7/1998 Bird et al. ..... 126/39 H
5,893,359 A * 4/1999 Schultheis et al. ..... 126/214 A
6,252,205 B1 * 6/2001 Schultheis et al. ..... 219/452.11
6,942,225 B2 * 9/2005 Gentemann et al. ..... 277/641

* cited by examiner

*Primary Examiner*—Alison K Pickard
(74) *Attorney, Agent, or Firm*—Patton Boggs LLP

(57) ABSTRACT

A cooktop gasket includes a sealing body having a stem extending from an upper portion of the gasket and terminating in a retention knuckle. A base is provided that includes a support portion integrally connected to a locking portion, the locking portion having an inner leg, an outer leg, and a retention channel positioned between the inner and outer legs. The retention channel is capable of the receiving the stem of the sealing body when the sealing body and the base are in an engaged position to maintain the relative positions of the base and sealing body. A sealing cam on the stem biases the inner leg toward a cooktop edge to seal against the edge of the cooktop.

8 Claims, 5 Drawing Sheets

COOKTOP GASKET

CROSS-REFERENCE TO RELATED APPLICATIONS

This application claims the benefit of U.S. Provisional Application No. 60/549,309, filed Mar. 2, 2004, which is hereby incorporated by reference.

BACKGROUND OF THE INVENTION

1. Field of the Invention

The present invention relates generally to gaskets and in particular to a two-piece gasket for sealing and supporting a cooktop within the frame of a range or stove.

2. Description of Related Art

Cooking appliances such as free-standing ranges and countertop "drop-in" stoves are available in many different types, shapes, and sizes. As shown in FIGS. 10-12, a free-standing range 621 combines an oven 623 and stove a 625 in one appliance and is capable of being placed directly on the floor of a kitchen. The stove 625 is typically heated either by gas or electric burners, while the oven 623 could be gas, electric, microwave, or some combination thereof. A popular feature on modern stoves is to include a ceramic glass cooktop 631 that covers a plurality of electric heating elements 633, all of which are supported within a cooktop frame 637. Referring more specifically to FIG. 12, the cooktop frame 637 typically includes a floor 645 integrally joined to a plurality of inner walls 647 to form a basin 649. Because the cooktop 631 and the heating elements 633 sit within the basin 649, and because the upper surface of the cooktop 631 is frequently exposed to food products, cleaning solutions, and other substances, it is desirable to provide a seal between the cooktop 631 and the cooktop frame 637.

The conventional method of sealing between a cooktop 631 and cooktop frame 637 employs a silicone, room-temperature-vulcanizing (RTV) sealant 655 because of the material's high heat resistance and the ability of the material to easily flow around the irregularly-shaped edge of the cooktop, thereby providing a complete seal. The sealant 655 is applied around the perimeter of the cooktop 631 as illustrated in FIG. 11. One problem with RTV sealant is that the material often maintains its tack following curing of the material. This presents a problem because food and other particles tend to stick to the RTV sealant 655, making cleaning the sealant bead difficult or impossible. Another problem is that the RTV sealant does not always provide an aesthetically pleasing, smooth transition between the cooktop 631 and the cooktop frame 637. If the RTV sealant is touched or disrupted prior to final curing, the final appearance of the sealant may appear rough or otherwise unattractive. RTV sealants have been preferred because the sealant can be easily manipulated into the space between the cooktop edge and the cooktop frame. Gaskets are generally not used for these sealing applications because it is difficult to obtain a reliable seal around an arcuate and irregularly-shaped surface such as the edge of a cooktop. If the gasket is installed prior to installation of the cooktop, it is difficult to have a reliable seal near the top surface of the cooktop. If the gasket is installed after installation of the cooktop, it is difficult to provide any sealing or support beneath the midpoint of the cooktop edge.

A need therefore exists for a sealing apparatus that provides exceptional sealing and support properties for a cooktop that is installed within a cooktop frame. It is further desirable to obtain a sealing apparatus that has exceptional heat resistance and provides a smooth, aesthetically-pleasing surface after installation of the apparatus and the cooktop. Finally, it is desirable to have a sealing apparatus that is not tacky and that is easily cleaned of any food particles or other residue that may contact the sealing apparatus.

BRIEF SUMMARY OF THE INVENTION

The problems presented by existing cooktop sealing techniques are solved by the systems of the present invention. A cooktop gasket is provided that includes a sealing body and a base. The sealing body includes a stem that extends from an upper portion of the sealing body and terminates in a retention knuckle. The upper portion of the sealing body includes an inside shoulder disposed on one side of the stem and an outside shoulder disposed on another side of the stem. The base includes a support portion integrally connected to a locking portion. The locking portion of the base includes an inner leg and an outer leg connected by a bridge to form a retention channel. The retention channel is capable of receiving the retention knuckle of the sealing body when the base and the sealing body are in an engaged position to maintain the relative positions of the base and the sealing body.

A cooktop gasket is further provided that includes a base having an inner leg, an outer leg, and a retention channel formed between the inner and outer legs. The cooktop gasket also includes a sealing body having a stem configured to be positioned within the retention channel of the base. When so positioned, the stem biases the inner leg toward an edge of a cooktop to provide sealing at a first location and a second location.

A cooktop gasket is further provided that includes a sealing body, a base, and a sealing cam. The sealing body includes a stem extending from an upper portion of the sealing body, while the base includes an inner leg, an outer leg, and a retention channel. The retention channel is formed between the inner and outer legs and is capable of receiving the stem of the sealing body when the base and the sealing body are in an engaged position. The sealing cam is disposed on the stem to bias the inner leg in a direction away from the outer leg.

Other objects, features, and advantages of the present invention will become apparent with reference to the drawings and detailed description that follow.

DETAILED DESCRIPTION OF THE PREFERRED EMBODIMENT

In the following detailed description of the preferred embodiments, reference is made to the accompanying drawings, which form a part hereof and in which is shown by way of illustration specific preferred embodiments in which the invention may be practiced. These embodiments are described in sufficient detail to enable those skilled in the art to practice the invention, and it is understood that other embodiments may be utilized and that logical mechanical, structural, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
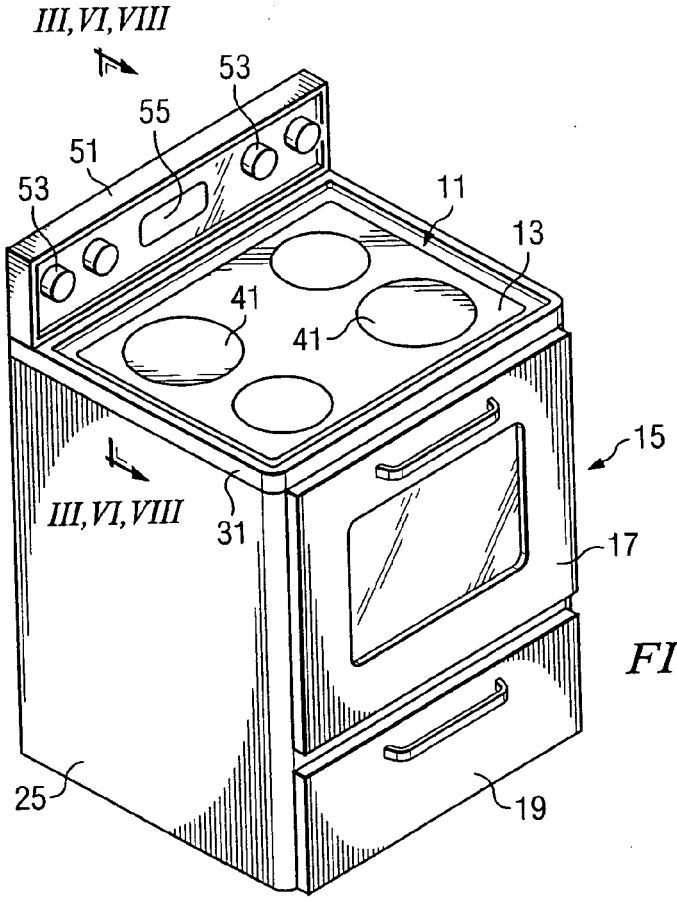
FIG. 1 illustrates a perspective view of a free-standing range having a cooktop surrounded and sealed by a multi-piece gasket according to the present invention.
Figure 2:
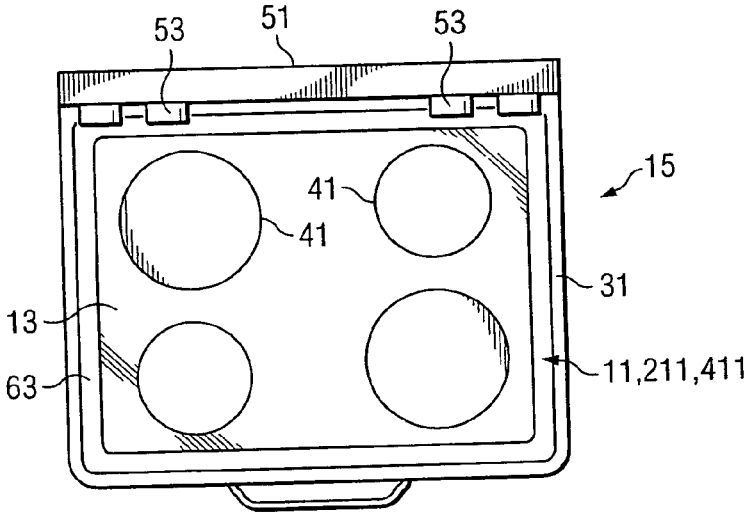
FIG. 2 depicts a top view of the free standing range and gasket of FIG. 1.
Figure 3:
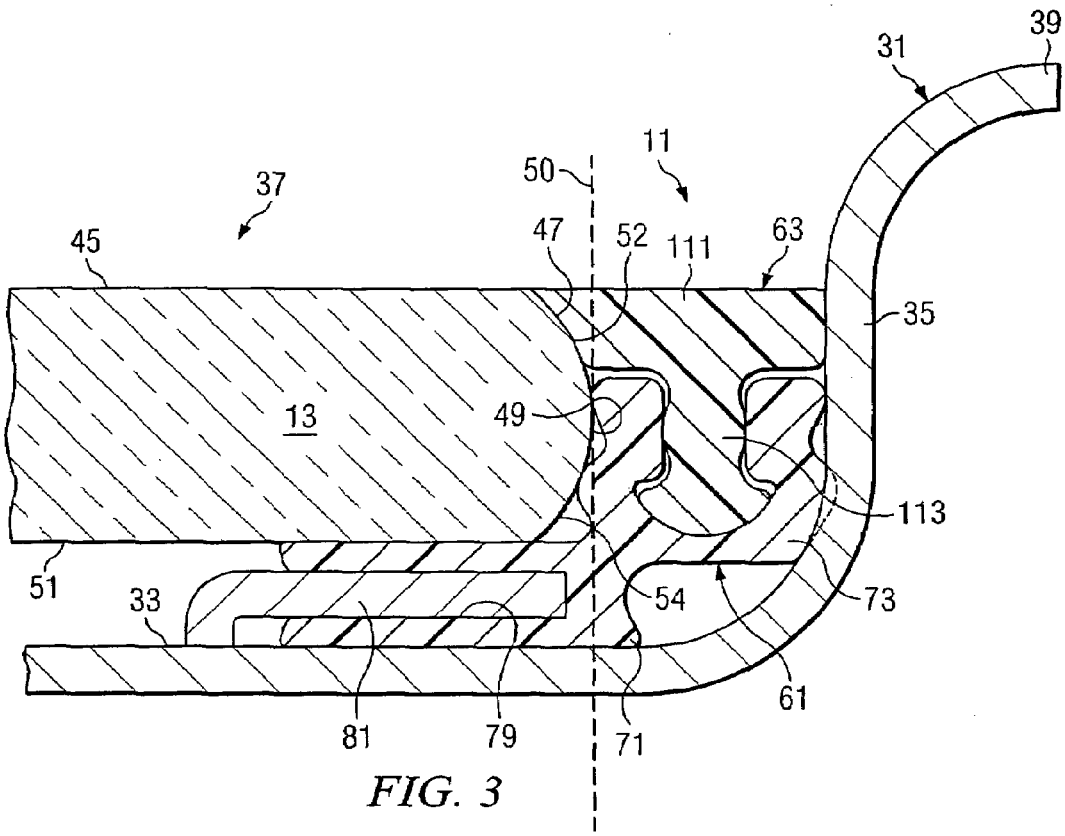
FIG. 3 illustrates a cross-sectional rear view of the cooktop and gasket of FIG. 1 taken at III-III, the gasket having a base and a sealing body interlockingly connected to seal the cooktop.

Referring to FIG. 1-3, a multi-piece gasket 11 according to the principles of the present invention is illustrated. The gasket 11 is used to seal and support a ceramic glass cooktop 13 found on free-standing ranges 15 such as that pictured in FIG. 1. Range 15 includes an oven 17 for baking food products and a storage drawer 19 positioned underneath the oven 17. Oven 17 could be of any type typically used in the appliance industry, including without limitation a radiant heating oven, a convection oven, or an oven that utilizes microwave or other electromagnetic energy for heating. A range housing 25 is positioned around the oven 17 and storage drawer 19 and conceals an oven frame (not shown) that supports both.

Referring more specifically to FIGS. 2 and 3, positioned above the oven frame is a cooktop frame 31 that is typically stamped from a heat-resistant metal. The cooktop frame 31 includes a floor 33 integrally connected to a plurality of inner walls 35 that collectively form a basin 37 for housing and supporting a plurality of heating elements 41 and the ceramic glass cooktop 13. The inner walls 35 extend upward from the floor 33 and are integrally connected to an upper wall 39 that surrounds the perimeter of the basin 37.

Cooktop 13 is typically formed from ceramic glass, which provides excellent heat resistance to the heating elements 41 housed beneath the cooktop 13. It should be noted, however, that other heat-resistant materials are sometimes used as cooktops and it is within the scope of the present invention to provide sealing and support for these cooktops as well. The cooktop 13 includes a smooth upper surface 45 for easy cleaning, but because of the methods used to manufacture the cooktop 13, a perimeter edge 47 of the cooktop 13 incorporates a pencil-grind radius, which will often include some surface irregularities. The perimeter edge 47 of the cooktop is generally arcuate in cross-sectional shape and includes a dividing point 49 at which a tangent line 50 to the perimeter edge 47 is substantially normal to the upper surface 45 of the cooktop. An upper edge region 52 of the perimeter edge 47 is that portion of the edge between the upper surface 45 and the dividing point 49 of the perimeter edge 47. A lower edge region 54 is that portion of the perimeter edge 47 between the dividing point 49 and a lower surface 51 of the cooktop 13. In FIG. 3, the dividing point 49 is located approximately midway between the upper surface 45 and the lower surface 51.

Range 15 also includes a control panel 51 positioned behind and above the cooktop 13. A plurality of cooktop control knobs 53 are rotatably attached to the control panel 51 for selectively powering and adjusting the temperature of heating elements 41. An oven display panel 55 preferably includes controls for adjusting and monitoring the temperature of oven 17.

Referring more specifically to FIG. 3, a preferred embodiment of gasket 11 is illustrated. The primary purpose of gasket 11 is to seal and support the cooktop 13 around its perimeter edge. Gasket 11 preferably includes a base 61 and a sealing body 63 that are separately installable in the basin 37 of the cooktop frame 31. The base 61 and sealing body 63 are configured to interlock in an engaged position (shown in FIG. 3) to maintain the relative position of the base 61 and the sealing body 63. Together, the base 61 and the sealing body 63 provide sealing and support for the cooktop 13. As illustrated in FIG. 2, the base 61 and sealing body 63 both extend completely and continuously around the perimeter of the cooktop 13 and preferably include no breaks, discontinuities, or other interruptions in the gasket 11.

Figure 4:
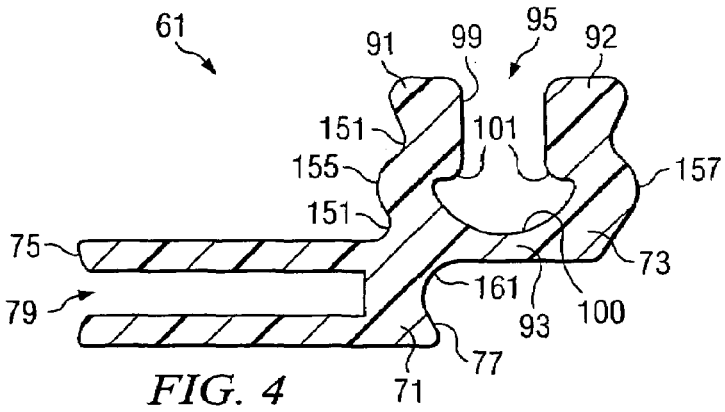
FIG. 4 depicts a cross-sectional rear view of the base of FIG. 3.

Referring still to FIG. 3, but also to FIG. 4, base 61 preferably includes a support portion 71 that is integrally connected to a locking portion 73. In the preferred embodiment, the cross-sectional shape of the support portion 71 is generally rectangular and includes an inside end 75 and an outside end 77. An anchor slot 79 with an opening at the inside end 75 of the support portion 71 is provided. The anchor slot 79 is configured to receive a tab 81 that is connected to the floor 33 of the cooktop frame 31. Tab 81 is the preferred method of anchoring the base 61 because a tab 81 such as that shown in FIG. 3 can be easily stamped or otherwise formed when the cooktop frame 31 is manufactured. While the anchor slot 79 preferably runs the entire length of the gasket around the perimeter of the cooktop 13, it is conceivable that the anchor slot 79 could be positioned intermittently within the base 61 in areas where tabs 81 will be provided. It should also be apparent to persons having ordinary skill in the art that the anchor slot 79 could be shaped differently or have an opening at the outside end 77 of the support portion 71 depending on the shape and orientation of the tab 81.

The locking portion 73 is integrally connected to the outside end 77 of the support portion 71 and includes an inner leg 91 and an outer leg 92 integrally connected by a bridge 93. Together, the legs 91, 92 and bridge 93 form a retention channel 95 having an entry region 99 and a bell region 100. The retention channel 95 preferably extends the entire length of the base 61 and is configured to receive a portion of the sealing body 63. The bell region 100 of the retention channel 95 defines a pair of retention shoulders 101 configured to retain the sealing body 63 after the base 61 and sealing body 63 are placed in the engaged position.

A plurality of contours and relief areas are provided on the base 61 to allow easier manipulation of the base 61 during installation of the cooktop 13. A pair of inner leg contours 151 is positioned on leg 91 on either side of a knee 155. The inner leg contours 151 decrease the thickness of the inner leg 91, which allows an operator installing the cooktop 13 to more easily move the inner leg 91 so that the cooktop 13 can be properly seated on the support portion 71 of the base 61. Since the base 61 is made from a flexible material, inner leg 91 can be pushed in the direction of outer leg 92 without plastically deforming the material. A knee 157 similar to knee 155 is also formed on the outer leg 92. The knees 155, 157 assist in sealing around the cooktop 13 when the gasket is installed between the cooktop frame 31 and the cooktop 13.

A lower relief area 161 is formed on the base 61 underneath the bridge 93 and adjacent to the outside end 77 of the support portion 71. The lower relief area 161 allows the locking portion 73 of the base 61 to be more easily manipulated relative to the support portion 71 of the base 61. While the base 61 has various contours and relief areas to increase the flexibility and manipulability of the gasket, these features could be omitted, or the shape and number of reliefs and contours could be varied without exceeding the scope of the present invention.

Figure 5:
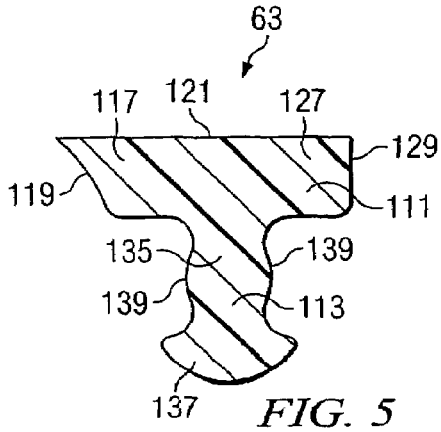
FIG. 5 illustrates a cross-sectional rear view of the sealing body of FIG. 3.

Referring to FIG. 5, the sealing body 63 includes an upper portion 111 and a lower portion 113, the upper portion 111 having an inside shoulder 117 terminating in an inside surface 119 and an outside shoulder 127 terminating in an outside surface 129. The inside surface 119 is tapered outward as it rises toward a top surface 121 and preferably includes an arcuate shape to approximately match the perimeter edge 47 of the cooktop 13. The outside surface 129 is either substantially vertical (see FIG. 5) or could be tapered outward slightly to improve its sealing characteristics when installed against the cooktop frame 31.

The lower portion 113 includes a stem 135 that extends from the upper portion 111 between the inside and outside shoulders 117, 127. The stem 135 terminates in an integrally-attached retention knuckle 137. Retention knuckle 137 is configured to fit within the retention channel 95 of the base 61 when the base 61 and the sealing body 63 are in the engaged position. A sealing cam 139 extends outward from each side of the stem 135 to engage and bias the legs 91 of the base 61 outward, thereby enhancing the sealing ability of the gasket 11. As illustrated in FIG. 3, the retention knuckle 137 has approximately the same shape as the bell region 100 of the retention channel 95, but the retention knuckle 137 is slightly smaller in size. During installation of the gasket 11, this sizing difference allows the retention knuckle 137, after being compressed to fit through the entry region 99, to fully expand when it enters the bell region 100. For similar reasons, the length of stem 135 is sized long enough to fully seat the retention knuckle 137 within the bell region 100 of the retention channel 95 even while leaving a small space between the shoulders 117, 127 of the sealing body 63 and legs 91, 92 of the base 61.

In operation, the base 61 and sealing body 63 are interlockingly assembled to provide both support and sealing to the cooktop 13. During the initial assembly of the range 15 and prior to installation of the cooktop 13, the base 61 of the gasket 11 is placed within the basin 37 of the cooktop frame 31 such that the locking portion 73 is positioned adjacent the inner walls 35 of the basin 37 and the support portion 71 is resting on the floor 33 of the basin 37 (see FIG. 3). The base 61 is secured to the cooktop frame 31 by positioning the anchor slot 79 around the tabs 81 disposed on the floor 33. Movement of the base 61 is relatively limited after securing the base 61 to the tabs 81 because the base 61 is now constrained from moving either inward or upward by the tabs and from moving outward by the inner walls 35. Although the base 61 is not visible in FIG. 2, this figure illustratively depicts that the gasket 11, including the base 61, is applied continuously around the entire perimeter of the basin 37.

After installation of the base 61, the cooktop 13 is carefully placed within the inner walls 35 of the basin 37 such that the cooktop 13 rests on the support portion 71 of the base 61 and the perimeter edge 47 of the cooktop 13 is adjacent to the inner leg 91 of the locking portion 73. The support portion 71 of the base 61 provides some support and cushioning for the cooktop 13 adjacent the perimeter edge 47. In most instances the cooktop 13 will be further supported by spacers, bushings, or other support structures placed between the floor 33 and the cooktop 13 away from the perimeter edge 47. In practice, placement of the cooktop 13 will likely require manipulation of the inner leg 91. After the inner leg 91 has been moved as needed and the cooktop 13 has been firmly seated on the support portion 71 of the base 61, the retention knuckle 137 of the sealing body 63 is inserted through the entry region 99 of the retention channel 95 and into the bell region 100. The legs 91, 92 of the base 61 are constrained by the cooktop 13 and the cooktop frame 31, so as the retention knuckle 137 moves through the entry region 99, the retention knuckle 137 is compressed. When the retention knuckle 137 reaches the bell region 100 of the retention channel 95, the retention knuckle 137 decompresses and resumes its normal shape. The decompression of the retention knuckle 137 within the bell region 100 securely locks the sealing body 63 to the base 61, thereby maintaining the relative positions of the base 61 and the sealing body 63. Attempts to remove the sealing body 63 will be met with resistance since the shoulders 101 resist movement of the retention knuckle 137 back into the entry region 99.

The base 61 and sealing body 63 are fully engaged when the retention knuckle 137 has been pushed into and has decompressed within the bell region 100 of the retention channel 95. When fully engaged, the gasket 11 provides support and sealing for the cooktop 13. The support portion 71 of the base 61 supports the cooktop 13 near its perimeter edge 47, and because the base is made from a flexible material, the base 61 cushions the cooktop 13 and reduces the likelihood of the cooktop 13 chipping or breaking. The locking portion 73 of the base 61 provides lateral support and cushioning for the cooktop 13 by preventing the cooktop 13 from moving closer to the inner walls 35 of the cooktop frame 31.

The gasket 11 provides primary sealing via the sealing body 63. When fully engaged with the base 61, the inside surface 119 and outside surface 129 of the sealing body 63 sealingly mate with the perimeter edge 47 of the cooktop 13 and the inner walls 35 of the cooktop frame 31, respectively. Preferably, the sealing body 63 is slightly compressed between the cooktop 13 and the cooktop frame 31 so that each surface 119, 129 exerts a force on its respective sealing surface, thereby increasing the sealing ability of the gasket 11. Secondary sealing is provided by the legs 91, 92 of the base 61, which are biased outward by the sealing cams 139 when the sealing body 63 and base 61 are fully engaged. The biasing force of the sealing cams 139 pushes the knee 155 and other portions of the inner leg 91 against the perimeter edge 47. Preferably, the inner leg 91 contacts the perimeter edge 47 in at least a first location and a second location. In FIG. 3, the first location is within the upper edge region 52 and is contacted by an upper corner of the inner leg 91. The second location is within the lower edge region 54 and is contacted by the knee 155. As schematically illustrated in FIG. 3, the shape of the outer leg 92 may not exactly match the contour of the inner wall 35; however, these differences in shape will cause additional compression of the locking portion 73, thereby increasing the ability of the gasket 11 to seal against the inner wall 35.

Figure 6:
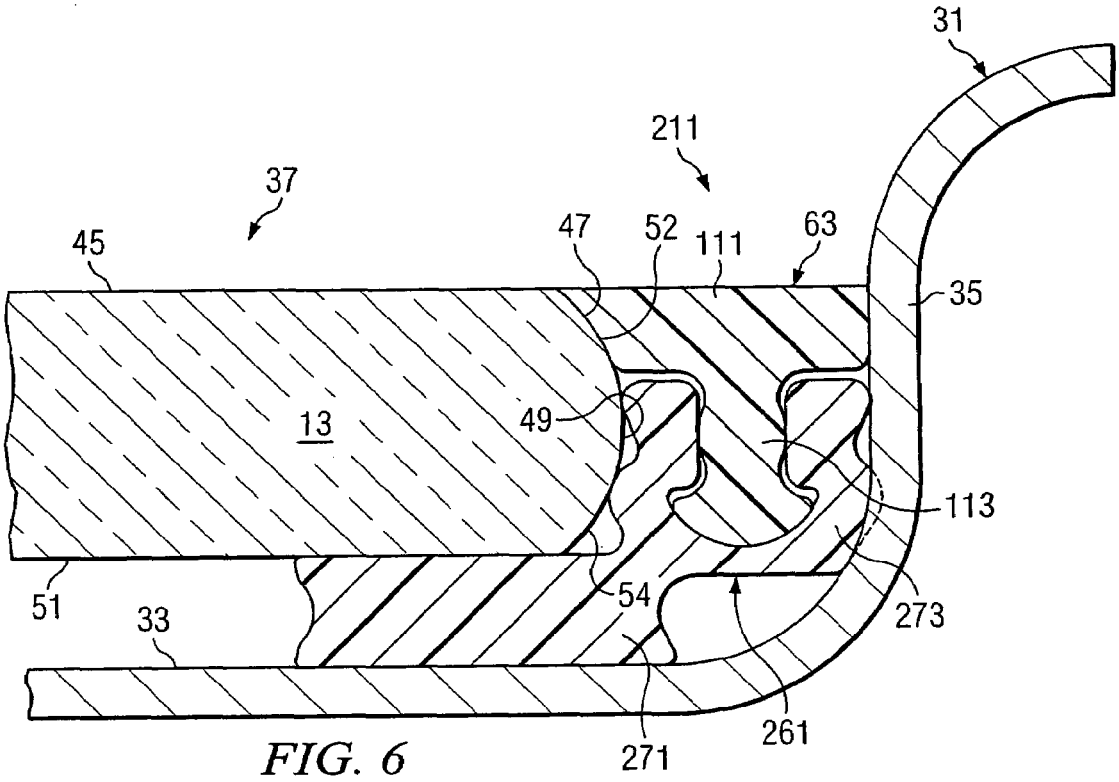
FIG. 6 depicts a cross-sectional rear view of the cooktop and gasket of FIG. 1 taken at VI-VI, the gasket having a base and a sealing body interlockingly connected to seal the cooktop.
Figure 7:
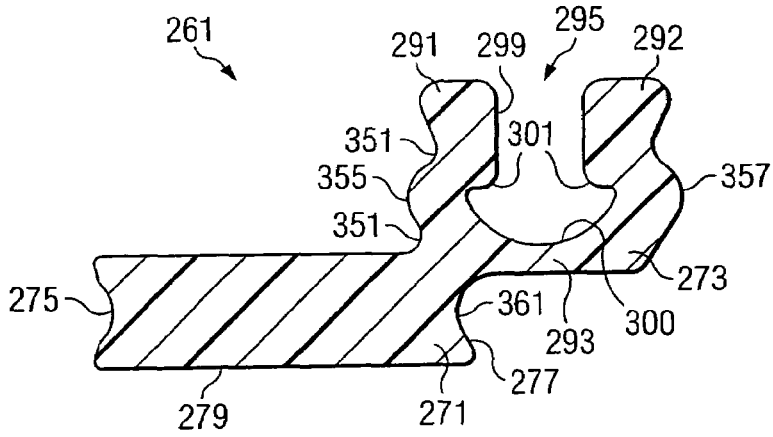
FIG. 7 illustrates a cross-sectional rear view of the base of FIG. 6.

While the base and sealing body of the present invention will generally involve interlocking parts that seal between the cooktop and the cooktop frame, the base of the gasket could be constructed differently depending on how it will be secured to the cooktop frame 31. Referring to FIGS. 6 and 7 in the drawings, a gasket 211 according to the principles of the present invention is illustrated. The primary purpose of gasket 211 is to seal and support the cooktop 13 around its perimeter edge. Gasket 211 preferably includes a base 261 and a sealing body that will be denoted sealing body 63 since it is identical to the sealing body discussed previously with reference to FIGS. 2, 3, and 5. The base 261 and the sealing body 63 are separately installable in the basin 37 of the cooktop frame 31. The base 261 and sealing body 63 are configured to interlock in an engaged position (shown in FIG. 6) to provide sealing and support for the cooktop 13. The base 261 and sealing body 63 both extend completely and continuously around the perimeter of the cooktop 13 and preferably include no breaks, discontinuities, or other interruptions in the gasket 211.

Base 261 preferably includes a support portion 271 that is integrally connected to a locking portion 273. In the preferred embodiment, the cross-sectional shape of the support portion 271 is generally rectangular and includes an inside end 275 and an outside end 277. In the present embodiment, no anchor slot 79 (see FIG. 4) is included on the base. Instead, the base includes a bottom surface 279 to which a pressure-sensitive adhesive is preferably applied. The pressure-sensitive adhesive allows the base 261 to be secured to the floor 33 of the cooktop frame 31 without the use of tabs, clips, or other attachment devices.

The locking portion 273 is integrally connected to the outside end 277 of the support portion 271 and includes an inner leg 291 and an outer leg 292 integrally connected by a bridge 293. Together, the legs 291, 292 and bridge 293 form a retention channel 295 having an entry region 299 and a bell region 300. The retention channel 295 preferably extends the entire length of the base 261 and is configured to receive a portion of the sealing body 63. The bell region 300 of the retention channel 295 defines a pair of retention shoulders 301 configured to retain the sealing body 63 after the base 261 and sealing body 63 are placed in the engaged position.

A plurality of contours and relief areas are provided on the base 261 to allow easier manipulation of the base 261 during installation of the cooktop 13. A pair of inner leg contours 351 is positioned on leg 291 on either side of a knee 355. The inner leg contours 351 decrease the thickness of the inner leg 291, which allows an operator installing the cooktop 13 to more easily move the leg so that the cooktop 13 can be properly seated on the support portion 271 of the base 261. Since the base 261 is made from a flexible material, inner leg 291 can be pushed in the direction of outer leg 292 without plastically deforming the material. A knee 357 similar to knee 355 is also formed on the outer leg 292. The knees 355, 357 assist in sealing around the cooktop 13 when the gasket is installed between the cooktop 13 and the cooktop frame 31.

A lower relief area 361 is formed in the base 261 underneath the bridge 293 and adjacent to the outside end 277 of the support portion 271. The lower relief area 361 allows the locking portion 273 of the base 261 to be more easily manipulated relative to the support portion 271 of the base 261. While the base 261 has various contours and relief areas to increase the flexibility and manipulability of the gasket, these features could be omitted, or the shape and number of reliefs and contours could be varied without exceeding the scope of the present invention.

In operation, the base 261 and sealing body 63 are interlockingly assembled in a manner similar to that described above for base 61 and sealing body 63. During initial assembly of the range 15 and prior to installation of the cooktop 13, the base 261 of the gasket 211 is placed within the basin 37 of the cooktop frame 31 such that the locking portion 273 is positioned adjacent the inner walls 35 of the basin 37 and the support portion 271 is resting on the floor 33 of the basin 37 (see FIG. 6). The base 261 is secured to the cooktop frame 31 by pressure-sensitive adhesive that is predisposed on the bottom surface 279 of the base 61. When the base 261 is firmly placed in position on the floor 33, the adhesive bonds the base 261 to floor 33. Of course, alternative adhesives could be used including without limitation thermosetting adhesive, thermoplastic adhesives, cyanoacrylate adhesives, epoxies, elastomeric adhesives, and alloy blend adhesives. Movement of the base 261 is relatively limited after securing the base 261 to the floor 33 because the base 261 is now constrained from moving either inward or upward by the adhesive and from moving outward by the inner walls 35. Although the base 261 is not visible in FIG. 2, this figure illustratively depicts that the gasket 211, including the base 261, is applied continuously around the entire perimeter of the basin 37.

Following installation of the base 261, the cooktop 13 is carefully placed within the inner walls 35 of the basin 37 such that the cooktop 13 rests on the support portion 271 of the base 261 and the perimeter edge 47 of the cooktop 13 is adjacent to the inner leg 291 of the locking portion 273. The support portion 271 of the base 261 provides some support and cushioning for the cooktop 13 adjacent the perimeter edge 47. In most instances the cooktop 13 will be further supported by spacers, bushings, or other support structures placed between the floor 33 and the cooktop 13 away from the perimeter edge 47. In practice, placement of the cooktop 13 will likely require manipulation of the inner leg 291. After the inner leg 291 has been moved as needed and the cooktop 13 has been firmly seated on the support portion 271 of the base 261, the retention knuckle 137 of the sealing body 63 is inserted through the entry region 299 of the retention channel 295 and into the bell region 300. The legs 291, 292 of the base 261 are constrained by the cooktop 13 and the cooktop frame 31, so as the retention knuckle 137 moves through the entry region 299, the retention knuckle 137 is compressed. When the retention knuckle 137 reaches the bell region 300 of the retention channel 295, the retention knuckle 137 decompresses and resumes its normal shape. The decompression of the retention knuckle 137 within the retention channel 295 securely locks the sealing body 63 to the base 261, thereby maintaining the relative positions of the base 261 and the sealing body 63. Attempts to remove the sealing body 63 will be met with resistance since the shoulders 301 resist movement of the retention knuckle 137 back into the entry region 299.

The base 261 and sealing body 63 are fully engaged when the retention knuckle 137 has been pushed into and has decompressed within the retention channel 295. When fully engaged, the gasket 211 provides support and sealing for the cooktop 13. The support portion 271 of the base 261 supports the cooktop 13 near its perimeter edge 47 and because the base 261 is made from a flexible material, the base 261 cushions the cooktop 13 and reduces the likelihood of the cooktop 13 chipping or breaking. The locking portion 273 of the base 261 provides lateral support and cushioning for the cooktop 13 by preventing the cooktop 13 from moving closer to the inner walls 35 of the cooktop frame 31.

The gasket 211 provides primary sealing via the sealing body 63. When fully engaged with the base 261, the inside surface 119 and outside surface 129 of the sealing body 63 sealingly mate with the perimeter edge 47 of the cooktop 13 and the inner walls 35 of the cooktop frame 31, respectively. Preferably, the sealing body 63 is slightly compressed between the cooktop 13 and the cooktop frame 31 so that each surface 119, 129 exerts a force on its respective sealing surface, thereby increasing the sealing ability of the gasket 211. Secondary sealing is provided by the legs 291, 292 of the base 261, which are biased outward by the sealing cams 139 when the sealing body 63 and base 261 are fully engaged. The biasing force of the sealing cams 139 pushes the knee 355 and other portions of the inner leg 291 against the perimeter edge 47. Preferably, the inner leg 291 contacts the perimeter edge 47 in at least a first location and a second location. In FIG. 6, the first location is within the upper edge region 52 and is contacted by an upper corner of the inner leg 291. The second location is within the lower edge region 54 and is contacted by the knee 355. As schematically illustrated in FIG. 6, the shape of the outer leg 292 may not exactly match the contour of the inner wall 35; however, these differences in shape will cause additional compression of the locking portion 273, thereby increasing the ability of the gasket 211 to seal against the inner wall 35.

Figure 8:
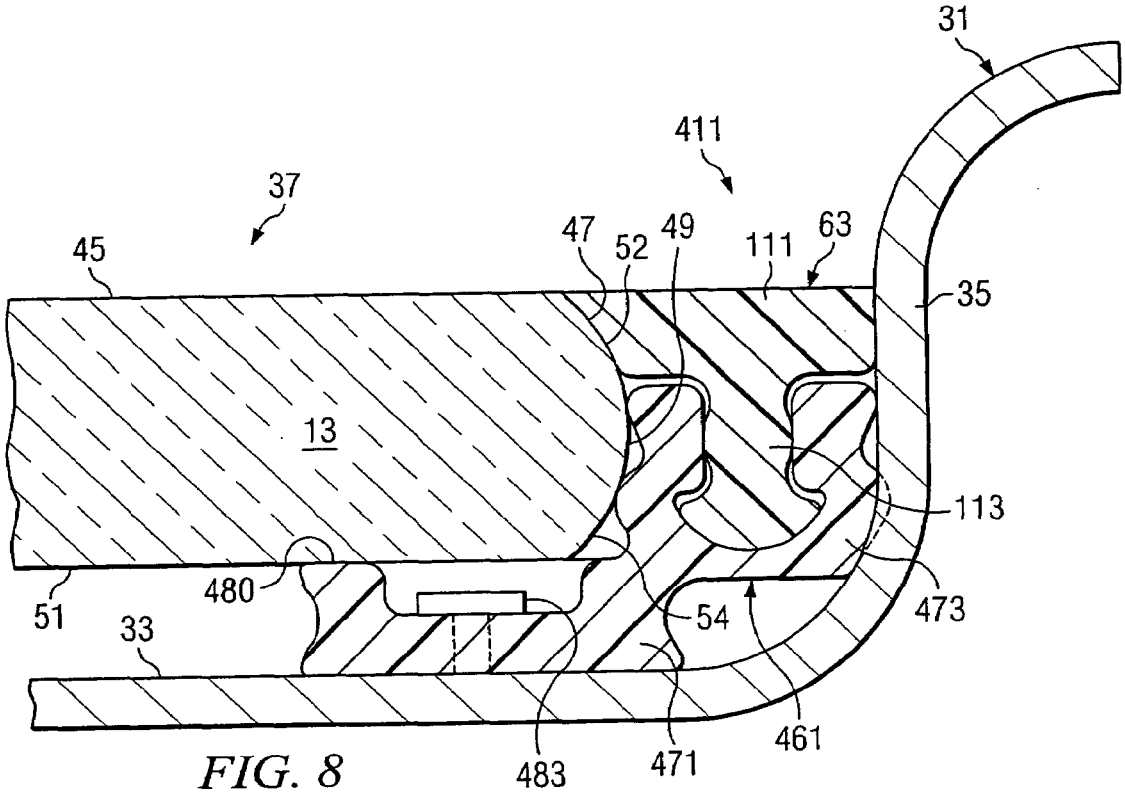
FIG. 8 depicts a cross-sectional rear view of the cooktop and gasket of FIG. 1 taken at VIII-VIII, the gasket having a base and a sealing body interlockingly connected to seal the cooktop.
Figure 9:
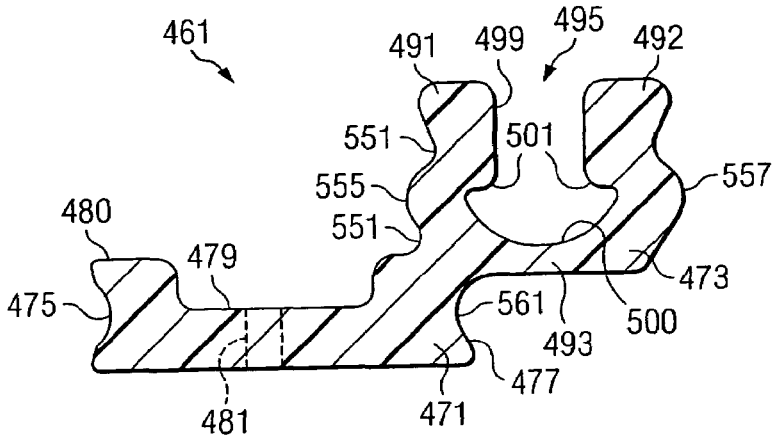
FIG. 9 illustrates a cross-sectional rear view of the base of FIG. 8.
Figure 10:
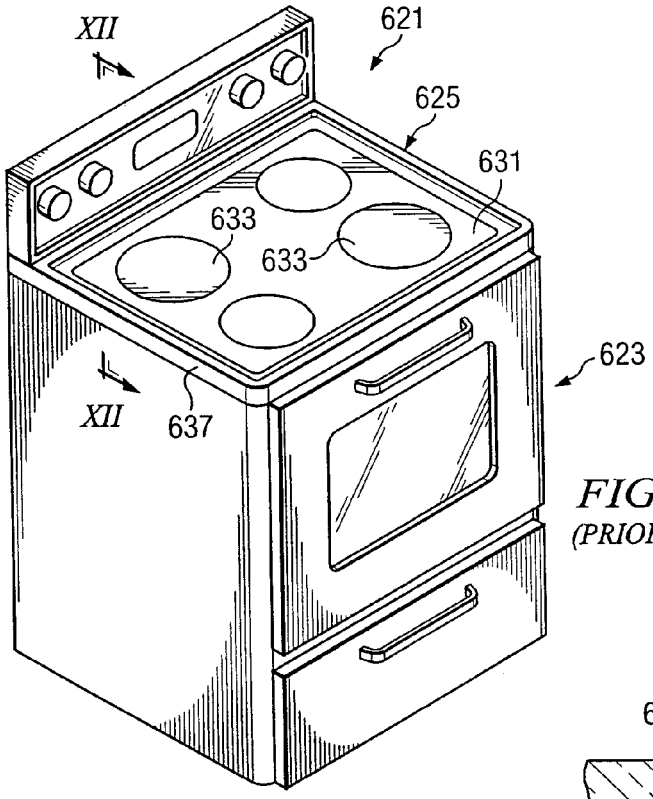
FIG. 10 (PRIOR ART)
FIG. 10 depicts a perspective view of a free-standing range having a cooktop surrounded and sealed using a prior art sealing method and material.
Figure 12:
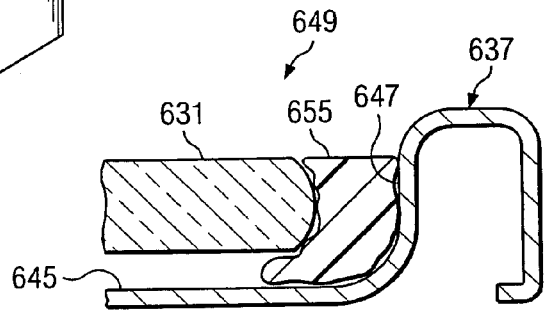
FIG. 12 (PRIOR ART)
FIG. 12 illustrates a cross-sectional rear view of the cooktop and sealing material of FIG. 10 taken at XII-XII.
Figure 11:
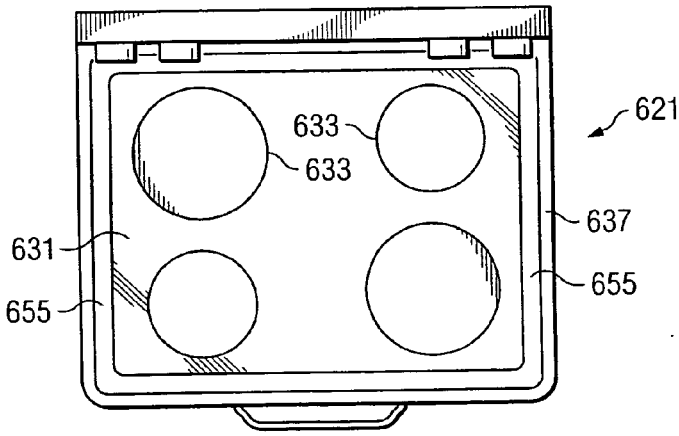
FIG. 11 (PRIOR ART)
FIG. 11 illustrates a top view of the free standing range and gasket of FIG. 10.

Referring to FIGS. 8 and 9 in the drawings, a gasket 411 according to the principles of the present invention is illustrated. The primary purpose of gasket 411 is to seal and support the cooktop 13 around its perimeter edge. Gasket 411 preferably includes a base 461 and a sealing body that will be denoted sealing body 63 since it is identical to the sealing body discussed previously with reference to FIGS. 2, 3, 5, 6, and 7. The base 461 and the sealing body 63 are separately installable in the basin 37 of the cooktop 13. The base 461 and sealing body 63 are configured to interlock in an engaged position (shown in FIG. 8) to provide sealing and support for the cooktop frame 31. The base 461 and sealing body 63 both extend completely and continuously around the perimeter of the cooktop 13 and preferably include no breaks, discontinuities, or other interruptions in the gasket 411.

Base 461 preferably includes a support portion 471 that is integrally connected to a locking portion 473. In the preferred embodiment, the cross-sectional shape of the support portion 471 is generally rectangular and includes an inside end 475 and an outside end 477. In the present embodiment, an anchor slot 479 with an opening located at a top surface 480 of the support portion 471 is provided. A hole 481 is positioned within the anchor slot 479 and passes through the support portion 471. The hole 481 and anchor slot 479 are configured to receive a clip 483, bolt, or other fastener that is either integrally connected or otherwise secured to the floor 33 of the cooktop frame 31. While the anchor slot 479 preferably runs the entire length of the gasket around the perimeter of the cooktop 13, holes 481 are only drilled at locations on the gasket that will coincide with clips 483 provided on floor 33. It is also conceivable that the anchor slot 479 could be positioned intermittently on the base 61 only in those areas where clips 483 will be provided. It should also be apparent to persons having ordinary skill in the art that the anchor slot 479 could be shaped differently and still accomplish the same attachment functionality described above.

The locking portion 473 is integrally connected to the outside end 477 of the support portion 471 and includes an inner leg 491 and an outer leg 492 integrally connected by a bridge 493. Together, the legs 491, 492 and bridge 493 form a belled retention channel 495 having an entry region 499 and a bell region 500. The retention channel 495 preferably extends the entire length of the base 461 and is configured to receive a portion of the sealing body 63. The bell region 500 of the retention channel 495 defines a pair of retention shoulders 501 configured to retain the sealing body 63 after the base 461 and sealing body 63 are placed in the engaged position.

A plurality of contours and relief areas are provided on the base 461 to allow easier manipulation of the base 461 during installation of the cooktop 13. A pair of inner leg contours 551 is positioned on leg 491 on either side of a knee 555. The inner leg contours 551 decrease the thickness of the inner leg 491, which allows an operator installing the cooktop 13 to more easily move the leg so that the cooktop 13 can be properly seated on the support portion 471 of the base 461. Since the base 461 is made from a flexible material, inner leg 491 can be pushed in the direction of outer leg 492 without plastically deforming the material. A knee 557 similar to knee 555 is also formed on the outer leg 492. The knees 555, 557 assist in sealing around the cooktop 13 when the gasket is installed between the cooktop frame 31 and the cooktop 13.

A lower relief area 561 is formed in the base 461 underneath the bridge 493 and adjacent to the outside end 477 of the support portion 471. The lower relief area 561 allows the locking portion 473 of the base 461 to be more easily manipulated relative to the support portion 471 of the base 461. In the present embodiment, the lower relief area 561 is further used during manufacturing to hold the base 461 while drilling holes 481 for the clips 483. While the base 461 has various contours and relief areas to increase the flexibility and manipulability of the gasket, these features could be omitted, or the shape and number of reliefs and contours could be varied without exceeding the scope of the present invention.

In operation, the base 461 and sealing body 63 are interlockingly assembled in a manner similar to that described above for base 61 and sealing body 63. During initial assembly of the range 15 and prior to installation of the cooktop 13, the base 461 of the gasket 411 is placed within the basin 37 of the cooktop frame 31 such that the locking portion 473 is positioned adjacent the inner walls 35 of the basin 37 and the support portion 471 is resting on the floor 33 of the basin 37 (see FIG. 8). The base 461 is secured to the cooktop frame 31 by inserting the clips 483 on floor 33 through holes 481 and into the anchor slot 479. Movement of the base 461 is relatively limited after securing the base 461 to the floor 33 because the base 461 is now constrained from moving either inward or upward by the clips 483 and from moving outward by the inner walls 35. Although the base 461 is not visible in FIG. 2, this figure illustratively depicts that the gasket 411, including the base 461, is applied continuously around the entire perimeter of the basin 37.

Following installation of the base 461, the cooktop 13 is carefully placed within the inner walls 35 of the basin 37 such that the cooktop 13 rests on the support portion 471 of the base 461 and the perimeter edge 47 of the cooktop 13 is adjacent to the inner leg 491 of the locking portion 473. The support portion 471 of the base 461 provides some support and cushioning for the cooktop 13 adjacent the perimeter edge 47. In most instances the cooktop 13 will be further supported by spacers, bushings, or other support structures placed between the floor 33 and the cooktop 13 away from the perimeter edge 47. In practice, placement of the cooktop 13 will likely require manipulation of the inner leg 491. After the inner leg 491 has been moved as needed and the cooktop 13 has been firmly seated on the support portion 471 of the base 461, the retention knuckle 137 of the sealing body 63 is inserted through the entry region 499 of the retention channel 495 and into the bell region 500. The legs 491, 492 of the base 461 are constrained by the cooktop 13 and the cooktop frame 31, so as the retention knuckle 137 moves through the entry region 499, the retention knuckle is compressed. When the retention knuckle 137 reaches the bell region 500 of the retention channel 495, the retention knuckle 137 decompresses and resumes its normal shape. The decompression of the retention knuckle 137 within the bell region 500 securely locks the sealing body 63 to the base 461, thereby maintaining the relative positions of the base 461 and the sealing body 63. Attempts to remove the sealing body 63 will be met with resistance since the shoulders 501 resist movement of the retention knuckle 137 back into the entry slot 499.

The base 461 and sealing body 63 are fully engaged when the retention knuckle 137 has been pushed into and has decompressed within the bell region 500 of the retention channel 495. When fully engaged, the gasket 411 provides support and sealing for the cooktop 13. The support portion 471 of the base 461 supports the cooktop 13 near its perimeter edge 47 and because the base is made from a flexible material, the base 461 cushions the cooktop 13 and reduces the likelihood of the cooktop 13 chipping or breaking. The locking portion 473 of the base 461 provides lateral support and cushioning for the cooktop 13 by preventing the cooktop 13 from moving closer to the inner walls 35 of the cooktop frame 31.

The gasket 411 provides primary sealing via the sealing body 63. When fully engaged with the base 461, the inside surface 119 and outside surface 129 of the sealing body sealingly mate with the perimeter edge 47 of the cooktop 13 and the inner walls 35 of the cooktop frame 31, respectively. Preferably, the sealing body 63 is slightly compressed between the cooktop 13 and the cooktop frame 31 so that each surface 119, 129 exerts a force on its respective sealing surface, thereby increasing the sealing ability of the gasket 411. Secondary sealing is provided by the legs 491, 492 of the base 461, which are biased outward by the sealing cams 139 when the sealing body 63 and base 461 are fully engaged. The biasing force of the sealing cams 139 pushes the knee 555 and other portions of the inner leg 491 against the perimeter edge 47. Preferably, the inner leg 491 contacts the perimeter edge 47 in at least a first location and a second location. In FIG. 8, the first location is within the upper edge region 52 and is contacted by an upper corner of the inner leg 491. The second location is within the lower edge region 54 and is contacted by the knee 555. As schematically illustrated in FIG. 8, the shape of the outer leg 492 may not exactly match the contour of the inner wall 35; however, these differences in shape will cause additional compression of the locking portion 473, thereby increasing the ability of the gasket 411 to seal against the inner wall 35.

The gaskets 11, 211, 411 of the present invention are preferably made from a silicone-based composition. The following table lists the optimal ranges and preferred amounts for the compound used to form the gasket.

TABLE 1

| Compound | Preferred Amount (Weight %) | Range (Weight %) |
|---|---|---|
| Silicone Base (Polydimethyvinylsiloxane/ Silica) | 62.0 | 40-70 |
| High Vinyl Silicone Gum | 1.4 | 0.5-10 |
| Repolymerized Silicone Filler | 13.0 | 5-25 |
| Ground Quartz | 20.0 | 5-50 |
| Pigment | 0.24 | 0.1-5 |
| Silicon Hydride | 2.3 | 0.1-25 |
| Chloro-platanic Acid | 0.90 | 0.1-5 |
| Ethynl Cyclohexanol | 0.16 | 0.05-5 |

The gasket compound includes a methyl vinyl silicone polymer, preferably polydimethyvinylsiloxane polymer, at an optimum range of about 40 to 70 weight percent, repolymerized silicone filler at an optimum range of about 5 to 25 weight percent, and ground quartz at an optimum range of about 5-50 weight percent. The preferred amounts for these components are about 62.0, 13.0, and 20.0 weight percent, respectively. The repolymerized silicone filler and quartz provide reinforcement for the compound. Other filler materials could alternatively be used, including without limitation calcium or other minerals.

The gasket compound includes a cross-linking agent to insure that the bonds of the compound form properly. The cross-linking agent may be a catalyst, such as platinum, or a curing agent such as peroxide. A platinum catalyst (i.e. chloro-platanic acid) is the preferred cross-linking agent for the compound and is included from about 0.1 to 5 weight percent, preferably 0.90 weight percent. Other catalysts, including but not limited to cesium, palladium, rhodium, iron, cobalt, nickel, rubidium, osmium, or iridium, could be used in place of platinum. However, these substances are generally not favored because they are either more expensive (e.g. palladium) or have problems associated with contamination (e.g. iron). Peroxide is not preferred as a cross-linking agent because it generally imparts an unpleasant odor to the cured compound, which is not generally desired since the gasket compound will be used near food products.

If a catalyst such as chloro-platanic acid is used, the following components are also added to the compound: high vinyl silicone gum from about 0.5 to 10 weight percent, silicon hydride from about 0.1 to 25 weight percent, and ethynl cyclohexanol from about 0.05 to 5 weight percent. The preferred amounts of these components are about 1.4, 2.3, and 0.16 weight percent, respectively. Both silicon hydride and high vinyl silicone gum are added to insure that the catalyzing reaction works properly. The vinyl component of high vinyl silicone gum is preferably 8-20 percent pendant vinyl with a preferred amount of 14 percent. Ethynl cyclohexanol is an inhibitor that prevents premature curing of the gasket compound at room temperature. A person of ordinary skill in the art will recognize that high vinyl silicone polymer, silicon hydride, and ethynl cyclohexanol are not necessary if the gasket compound is peroxide cured.

The gasket compound preferably includes a pigment from about 0.1 to 5 weight percent, preferably 0.24 weight percent. Many different pigments could be used to give the gasket 11, 211, 411 a distinctive color. In a preferred embodiment, black iron oxide is used to give the gasket compound a black color.

A person of ordinary skill in the art will recognize that the components of the compound are mixed in a manner similar to that of other compounds. No extraordinary mixing procedures are required; however, for the compound to properly cure, it is best to mix the various components such that the cross-linking agent (e.g. chloro-platanic acid) is added last. This prevents premature curing of the compound.

The silicone-based compound is preferred because of its excellent heat resistance and because the material is relatively easy and inexpensive to manufacture. While the preferred composition for the gasket 11, 211, 411 is a silicone-based compound, the gasket could be manufactured from any material that would provide enough flexibility to allow installation of the cooktop 13 and provide adequate sealing after the cooktop 13 is in place. Alternative materials could include without limitation natural rubber, ethylene propylene diene monomer (EPDM), silicone sponge, nitrile, or any other elastomer that would have comparable flexibility and heat resistance.

The gasket 11, 211, 411 is preferably extruded to form the cross-sections illustrated in FIGS. 3, 6, and 8. The compound is typically extruded at a curing temperature of 400° F. to 600° F. for about 1 to 4 minutes. The curing of the silicone gasket can take place using any continuous vulcanizing method. The vulcanizing mediums could include without limitation hot air, liquid (e.g. salt bath), infrared energy, gamma energy, or microwave energy.

After curing the extrudate is cut to length. The cutting process can occur on-line as part of the extrusion process using automated cutting equipment. Alternatively, the extrudate can be cut off-line by placing the material into a cutting fixture and cutting the material to the proper length by hand.

For each length of material, the two ends of the material are preferably joined to form the gasket into a hoop (or loop) that will circumscribe the cooktop upon installation. The gasket ends can be joined using RTV or other adhesive, staples, clips, or other fasteners. Preferably, the gasket ends are bonded within a mold using a silicone bonding substrate. The preferred number of "bonds" within a hoop gasket is one; however, additional bonds could be used to provide the desired hoop length.

It should be apparent to a person of ordinary skill in the art that the gasket could be manufactured, cut, and joined into hoops using any method that is suitable for forming elastomeric products. Some alternative manufacturing methods include, but are not limited to, injection molding, compression molding, and transfer molding. It should also be noted that while the gasket is preferably formed into a hoop for placement around the cooktop, the gasket could be provided and installed as a strip of material with unjoined ends.

The primary advantage of the present invention is that it provides a novel method and apparatus for sealing and supporting a cooktop placed within a cooktop frame. In most cases, the process for manufacturing a ceramic glass cooktop creates an arcuate and irregular perimeter edge. The multi-piece gasket of the present invention allows support and sealing of the cooktop below a dividing point of the cooktop edge by providing a base that is installed prior to installation of the cooktop. Sealing and support of the cooktop above the dividing point of the perimeter edge is then provided by a sealing body that lockingly engages the base.

Another advantage provided by the gasket is that it is inexpensively and easily manufactured from a silicone-based compound. The gasket therefore has exceptional resistance to heat, which is extremely advantageous because of the gasket's proximity to the heating elements or burners. The silicone material also provides a non-tacky, smooth transition between the edge of the cooktop and the cooktop frame that is easily cleaned with either soap and water or gentle cleaning solutions.

Even though many of the examples discussed herein are applications of the present invention with cooktops on free-standing ranges, the present invention also can be applied to any other type of cooktop that is installed within some type of frame or other support device. These cooktops could include those made of ceramic glass or any other type of material that may need perimeter sealing and support.

One skilled in the art will also see that the present invention can be applied in many areas where there is a need to provide support and sealing around a surface that has an arcuate or irregularly-shaped perimeter edge. One example of such a surface could include a window that is installed within a window frame. On some windows made of especially thick glass, a pencil-grind radius may be present on the perimeter edges of the window. The gasket of the present invention could be positioned between the window and the window frame to provide an aesthetically-pleasing seal and to provide cushioning support for the window.

It should be apparent from the foregoing that an invention having significant advantages has been provided. While the invention is shown in only a few of its forms, it is not just limited but is susceptible to various changes and modifications without departing from the spirit thereof.

I claim:

1. A cooktop gasket positionable between a cooktop frame and a cooktop having an edge against which the gasket seals, the gasket comprising:

a base having an inner leg, an outer leg, and a retention channel formed between the inside and outer legs;

a sealing body having a stem configured to be positioned within the retention channel of the base such that the stem biases the inner leg toward the edge of the cooktop to provide sealing at a first location and a second location;

wherein the stem of the sealing body extends from an upper portion of the sealing body and terminates in a retention knuckle;

wherein the retention channel includes an entry region and a bell region, the bell region being capable of receiving the retention knuckle of the sealing body when the base and the sealing body are in an engaged position to maintain relative positions of the base and the sealing body; and wherein the retention knuckle is smaller than the bell region to allow full expansion of the retention knuckle within the bell region when the base and the sealing body are in the engaged position.

2. The cooktop gasket according to claim 1, wherein:

the edge of the cooktop is arcuately shaped and includes a dividing point at which a tangent line to the arcuate edge is substantially normal to an upper surface of the cooktop, the arcuate edge further including an upper edge region between the upper surface and the dividing point and a lower edge region below the dividing point and opposite the upper edge region; and the first location is within the upper edge region and the second location is within the lower edge region.

3. The cooktop gasket according to claim 1, wherein sealing is provided against the cooktop by both the base and the sealing body.

4. The cooktop gasket according to claim 1, wherein sealing is provided against the cooktop frame by both the base and the sealing body.

5. The cooktop gasket according to claim 1 further comprising an anchor slot positioned in the base to attach the base to the cooktop frame.

6. The cooktop gasket according to claim 1 further comprising leg contours disposed on the inner leg to allow manipulation of the inner leg during installation of the cooktop.

7. The cooktop gasket according to claim 1, wherein:

the upper portion of the sealing body includes an inside shoulder disposed on one side of the stem and an outside shoulder disposed on another side of the stem; and the inside shoulder of the sealing body includes an inside surface having an arcuate shape to substantially match and seal against the edge of the cooktop.

8. The cooktop gasket according to claim 1 further comprising a sealing cam disposed on the stem to engage and bias the inner leg toward the edge of the cooktop.

* * * * *